US005626694A

United States Patent [19]

Kawabata et al.

[11] Patent Number: 5,626,694

[45] Date of Patent: May 6, 1997

[54] PROCESS FOR THE PRODUCTION OF STAINLESS STEEL SHEETS HAVING AN EXCELLENT CORROSION RESISTANCE

[75] Inventors: Yoshikazu Kawabata; Susumu Satoh; Mitsuyuki Fujisawa; Kunio Fukuda, all of Chiba, Japan

[73] Assignee: Kawasaki Steel Corporation, Japan

[21] Appl. No.: 522,383

[22] PCT Filed: Jan. 26, 1995

[86] PCT No.: PCT/JP95/00092

§ 371 Date: Sep. 22, 1995

§ 102(e) Date: Sep. 22, 1995

[87] PCT Pub. No.: WO95/20683

PCT Pub. Date: Mar. 8, 1995

[30] Foreign Application Priority Data

Jan. 26, 1994 [JP] Japan ..... 6-007021

[51] Int. Cl.[6] ..... C21D 8/02

[52] U.S. Cl. ..... 148/609; 148/610; 148/654

[58] Field of Search ..... 148/609, 610, 148/654, 661

[56] References Cited

U.S. PATENT DOCUMENTS 5,314,549 5/1994 Misao et al. .

FOREIGN PATENT DOCUMENTS 60-57501 12/1985 Japan .
2-14419 4/1990 Japan .
2-46662 10/1990 Japan .
40509322 4/1993 Japan ..... 148/610

*Primary Examiner*—Deborah Yee
*Attorney, Agent, or Firm*—Austin R. Miller

[57] ABSTRACT

This invention relates to a process for the production of stainless steel sheets and proposes a process for the production of stainless steel sheets having a more excellent corrosion resistance as compared with the conventional one without trimming the steel sheet surface after annealing-pickling by preventing the chapping of steel sheet surface created in the production of present stainless steel sheet, particularly stainless steel sheets having extreme-low amounts of C, S, O.

For this purpose, according to the invention, a starting material of stainless steel containing C: not more than 0.01 wt %, S: not more than 0.005 wt % and O: not more than 0.005 wt % is subjected to a hot rolling at a draft below 830° C. of not less than 30%, cooled at a cooling rate of not less than 25° C. sec, coiled below 650° C. and then annealed and pickled.

7 Claims, 3 Drawing Sheets

PROCESS FOR THE PRODUCTION OF STAINLESS STEEL SHEETS HAVING AN EXCELLENT CORROSION RESISTANCE

TECHNICAL FIELD

This invention relates to a process for the production of stainless steel, and more particularly to a process for the production of stainless steel sheets having an excellent corrosion resistance.

BACKGROUND ART

Stainless steel sheets are excellent in the corrosion resistance under various corrosive environments and are widely used as building materials, materials for automobiles, materials for chemical plants and so on. Recently, there are observed many examples of service environments which are becoming more severe and the stainless steel sheet is demanded to have a more excellent corrosion resistance. On the other hand, stainless steels which take too much labor in their production, even though the corrosion resistance is excellent, are unfavorable to stainless steel manufacturers, so that it is desired that the stainless steel is excellent in the productivity, particularly hot workability.

Under the above circumstances, it has recently become possible to reduce impurities in steel with the advance of steel-making techniques, so as to improve the above corrosion resistance and hot workability by decreasing C, S and O in the stainless steel. For example, JP-B-60-57501 discloses a method of improving anti-corrosion in sea water and hot workability by decreasing C, S and O, and JP-B-2-46662 and JP-B-2-14419 disclose a method of likely improving the hot workability.

According to the above conventional improving techniques, however, there may be created remarkable chapping in a surface of stainless steel sheet after hot rolling-annealing-pickling. Such a chapping falls down during cold rolling to remain as a scab-like defect after the cold rolling, which undesirably deteriorates the corrosion resistance in hot rolled steel sheet and cold rolled steel sheet.

Of course, it has been attempted to trim the chapped surface of the steel sheet by means of a grinder or the like, which brings about the decrease of productivity and the rise of cost and is not an advantageous countermeasure. For this end, it is strongly desired to establish a technique of not creating the above chapping on the surface of the stainless steel sheet after annealing-pickling.

DISCLOSURE OF INVENTION

It is, therefore, a main object of the invention to solve the aforementioned problems in the production of the present stainless steel sheets, particularly stainless steel sheets having extreme-low amounts of C, S and O and to provide a process for the production of stainless steel sheets having more improved corrosion resistance as compared with the conventional ones without trimming the surface of the steel sheet after annealing-pickling.

In order to achieve the above object, there have been made various studies with respect to causes of creating the chapping on the surface of the conventional stainless steel sheet after annealing-pickling and also means for the prevention thereof has been examined. As a result, the following facts have been confirmed. That is, 1) The chapping of the steel sheet surface is caused due to the fact that Cr-removed layer formed in the annealing is eroded with an acid to form unevenness on the surface of the steel sheet.

2) The Cr-removed layer grows as an amount of scale ($Fe_3O_4$) in the hot rolled sheet becomes large.

3) The Cr-removed layer grows as an adhesion property of scale ($Fe_3O_4$) in the hot rolled sheet to iron matrix becomes strong.

4) The scale $Fe_3O_4$ in the hot rolled sheet is formed at a relatively low temperature below 830° C.

From the above facts, the inventors have noticed the following:

5) In order to prevent the chapping of the steel sheet surface, it is effective to decrease the amount of scale $Fe_3O_4$ and to lower the adhesion property to iron matrix.

6) In order to decrease the amount of scale $Fe_3O_4$ and lower the adhesion property to iron matrix, it is effective to control a finish temperature of hot rolling, and a cooling rate and a coiling temperature followed thereto.

Although a mechanism of forming the Cr-removed layer through the aforementioned scale ($Fe_3O_4$) is not necessarily clear, the followings are considered.

In general, the annealing of a cold rolled stainless steel sheet is carried out in a relatively high temperature and low oxygen atmosphere. If the stainless steel is annealed in such an atmosphere, it is oxidized to form $Cr_2O_3$, but since this $Cr_2O_3$ has a protection property to oxidation, the oxidation rate gradually lowers and finally the Cr-removed layer hardly forms on the surface of the steel sheet. In the hot rolling of the stainless steel (hereinafter abbreviated as hot rolling in some cases), the atmosphere is different from that in the above annealing, so that scale composed mainly of $Fe_3O_4$ is formed. When this $Fe_3O_4$ scale has a strong adhesion property to iron matrix, the scale absorbs Cr from the iron matrix in the annealing according to the following reaction:

$$(3/2)\ O_2+Fe_3O_4+2Cr \rightarrow Fe_2O_3+FeCr_2O_4$$

or $$4O_2+Fe_3O_4+6Cr \rightarrow 3FeCr_2O_4$$

Thus, when $Fe_3O_4$ is existent on the surface, Cr is consumed without the formation of $Cr_2O_3$ having a protection property to oxidation and hence it is considered to considerably promote the growth of the Cr-removed layer.

Further, the reason why the $Fe_3O_4$ scale in the hot rolled sheet grows at a relatively low temperature below 830° C. is considered due to the fact that when the steel sheet is cooled in air after the hot rolling, Fe is sufficiently rapidly oxidized, while Cr in steel is slow in the diffusion and can not diffuse up to the surface and hence the main component of the scale is Fe. And also, the reason why the degree of surface chapping after the pickling in stainless steel containing extreme-low levels of C, S and O is larger than that of stainless steel containing approximately usual level of C, S and O is considered due to the fact that the adhesion property of scale to iron matrix is high in the stainless steel containing extreme-low levels of C, S and O.

The invention is based on the above knowledge. That is, the essential point and construction of the invention are as follows.

(1) A process for the production of stainless steel sheets having an excellent corrosion resistance, characterized in that a starting material of stainless steel containing C: not more than 0.01 wt %, S: not more than 0.005 wt % and O: not more than 0.005 wt % is subjected to a hot rolling at a draft below 830° C. of not less than 30%, and the resulting hot rolled sheet is coiled at a cooling rate of not less than 25°

C./sec and coiled at a temperature of not higher than 650° C. and thereafter is subjected to annealing and pickling (first embodiment).

(2) A process for the production of stainless steel sheets having an excellent corrosion resistance, characterized in that a starting material of stainless steel containing C: not more than 0.01 wt %, S: not more than 0.005 wt % and O: not more than 0.005 wt % is subjected to a hot rolling at a draft below 830° C. of not less than 30% to a thickness of not more than 1.5 mm, and the resulting hot rolled sheet is coiled at a cooling rate of not less than 25° C./sec and coiled at a temperature of not higher than 650° C. and thereafter is successively subjected to annealing, pickling and skin pass rolling at a draft of not more than 20% (second embodiment).

(3) A process for the production of stainless steel sheets having an excellent corrosion resistance, characterized in that a starting material of stainless steel containing C: not more than 0.01 wt %, S: not more than 0.005 wt % and O: not more than 0.005 wt % is subjected to a hot rolling at a draft below 830° C. of not less than 30%, and the resulting hot rolled sheet is coiled at a cooling rate of not less than 25° C./sec and coiled at a temperature of not higher than 650° C. and thereafter is subjected to annealing and pickling, and then subjected to a cold rolling at a total draft of more than 20% in a cold rolling installation provided with work rolls having a roll diameter of not less than 250 mm (third embodiment).

(4) A process according to anyone of the first to third embodiments, wherein a ferritic stainless steel comprising C: not more than 0.01 wt %, S: not more than 0.005 wt %, O: not more than 0.005 wt %, Si: not more than 3 wt %, Mn: not more than 5 wt %, Cr: 9–50 wt %, Ni: less than 5 wt %, and the remainder being Fe and inevitable impurities is used as the starting material (fourth embodiment).

(5) A process according to anyone of the first to third embodiments, wherein a ferritic stainless steel comprising C: not more than 0.01 wt %, S: not more than 0.005 wt %, O: not more than 0.005 wt %, Si: not more than 3 wt %, Mn: not more than 5 wt %, Cr: 9–50 wt %, Ni: less than 5 wt %, and further containing one or more elements selected from the group consisting of Ti: 0.01–1.0 wt %, Nb: 0.01–1.0 wt %, V: 0.01–1.0 wt %, Zr: 0.01–1.0 wt %, Ta: 0.01–1.0 wt %, Co: 0.1–5 wt %, Cu: 0.1–5 wt %, Mo: 0.1–5 wt %, W: 0.1–5 wt %, Al: 0.005–5.0 wt %, Ca: 0.0003–0.01 wt % and B: 0.0003–not more than 0.01 wt %, and the remainder being Fe and inevitable impurities is used as the starting material (fifth embodiment).

(6) A process according to anyone of the first to third embodiments, wherein an austenitic stainless steel or dual-phase stainless steel comprising C: not more than 0.01 wt %, S: not more than 0.005 wt %, O: not more than 0.005 wt %, Si: not more than 3 wt %, Mn: not more than 20 wt %, Cr: 9–50 wt %, Ni: 5–20 wt %, N: not more than 0.2 wt %, and the remainder being Fe and inevitable impurities is used as the starting material (sixth embodiment).

(7) A process according to anyone of the first to third embodiments, wherein an austenitic stainless steel or dual-phase stainless steel comprising C: not more than 0.01 wt %, S: not more than 0.005 wt %, O: not more than 0.005 wt %, Si: not more than 3 wt %, Mn: not more than 20 wt %, Cr: 9–50 wt %, Ni: 5–20 wt %, N: not more than 0.2 wt %, and further containing one or more elements selected from the group consisting of Ti: 0.01–1.0 wt %, Nb: 0.01–1.0 wt %, V: 0.01–1.0 wt %, Zr: 0.01–1.0 wt %, Ta: 0.01–1.0 wt %, Co: 0.1–5 wt %, Cu: 0.1–5 wt %, Mo: 0.1–5 wt %, W: 0.1–5 wt %, Al: 0.005–5.0 wt %, Ca: 0.0003–0.01 wt % and B: 0.0003–not more than 0.01 wt %, and the remainder being Fe and inevitable impurities is used as the starting material (seventh embodiment).

As the selective addition element in the fifth or seventh embodiment, it is effective to use elements in each group of ① Ti, Nb, V, Zr, Ta, ② Co, Cu, ③ Mo, W, ④ Al, ⑤ Ca and ⑥ B alone or add a combination of two or more elements selected from each group of ①–⑥.

The reason why the invention is limited to the above essential point and construction will be described below.

Draft below 830° C. of not less than 30%;

In the extreme-low C, S, O stainless steel, the working in the above range acts to lower the adhesion property between scale and iron matrix by generating cracks in $Fe_3O_4$ scale produced in the hot rolling, whereby the growth of the Cr-removed layer can be controlled in the annealing to enhance the corrosion resistance.

Thus, the draft below 830° C. particularly promoting the growth of the $Fe_3O_4$ scale is important. When the value of the draft is less than 30%, sufficient strain amount is not given and hence sufficient cracks for the improvement of corrosion resistance can not be introduced. Therefore, the draft below 830° C. is necessary to be not less than 30%.

Moreover, the term "draft" used herein is a ratio of sheet thickness after hot rolling to thickness of the steel sheet at 830° C. and may be attained by plural times of rolling or single rolling. And also, it is desirable that the rolling temperature is low, but when the rolling temperature is too low, surface defects in the hot rolling increases and hence the unevenness after the pickling is increased by factors other than the Cr-removed layer produced through oxidation in the annealing. Therefore, it is desirable that the rolling is carried out at a temperature of not lower than 700° C.

The influence of the draft below 830° C. upon corrosion resistance of each of hot rolled sheet and cold rolled sheet is shown in FIG. 1 using extreme-low C, extreme-low S, extreme-low O steel (hereinafter referred to as extreme-low CSO steel simply, C: 0.0050 wt %, S: 0.0040 wt %, O: 0.0040 wt %) and commercially available steel (C: 0.0500 wt %, S: 0.0082 wt %, O: 0.0068 wt %) as two kinds of SUS 304, and in FIG. 2 using extreme-low CSO steel (C: 0.0020 wt %, S: 0.0038 wt %, O: 0.0030 wt %) and commercially available steel (C: 0.0520 wt %, S: 0.0068 wt %, O: 0.0065 wt %) as two kinds of SUS 430, respectively. Moreover, the hot rolled sheet is obtained by subjecting to hot rolling (cooling rate: 40° C./sec, coiling temperature: 600° C.)-annealing-pickling, and the cold rolled sheet is obtained by subjecting to hot rolling (cooling rate: 45° C./sec, coiling temperature: 600° C.)-annealing-pickling-cold rolling (draft at roll diameter of 250 mm: 50%)-annealing-pickling. The corrosion resistance is evaluated by rust generating area ratio after 2 days of CCT test.

In these figures, symbol ■ is a hot rolled sheet of the extreme-low CSO steel, symbol □ is a cold rolled sheet of the extreme-low CSO steel, symbol ● is a hot rolled sheet of the commercially available steel, and symbol ○ is a cold rolled sheet of the commercially available steel. From these figures, it is understood that when the draft below 830° C. is not less than 30%, there is particularly an effect of considerably improving the corrosion resistance for the extreme-low CSO steel.

Cooling rate of not less than 25° C./sec;

When the cooling rate is increased after the completion of the hot rolling, not only the amount of scale produced after the hot rolling is decreased, but also the adhesion property between scale and iron matrix is decreased based on the difference of thermal expansion to the iron matrix, so that the increase of the cooling rate is effective for the peeling of the scale. Thus, the growth of the Cr-removed layer can be controlled in the subsequent annealing to enhance the corrosion resistance.

Since such an effect is not obtained at a cooling rate of less than 25° C./sec, the cooling rate is limited to not less than 25° C./sec. Moreover, the preferable cooling rate is not less than 40° C./sec.

The influence of the cooling rate after the completion of the hot rolling upon corrosion resistance of each of hot rolled sheet and cold rolled sheet is shown in FIG. 3 using extreme-low CSO steel (C: 0.0050 wt %, S: 0.0040 wt %, O: 0.0040 wt %) and commercially available steel (C: 0.0500 wt %, S: 0.0082 wt %, O: 0.0068 wt %) as two kinds of SUS 304, and in FIG. 4 using extreme-low CSO steel (C: 0.0020 wt %, S: 0.0038 wt %, O: 0.0030 wt %) and commercially available steel (C: 0.0520 wt %, S: 0.0068 wt %, O: 0.0065 wt %) as two kinds of SUS 430, respectively. Moreover, the hot rolled sheet is obtained by subjecting to hot rolling (draft below 830° C.:30%, coiling temperature: 550° C.)-annealing-pickling, and the cold rolled sheet is obtained by subjecting to hot rolling (draft below 830° C.:35%, coiling temperature: 550° C.)-annealing-pickling-cold rolling (draft at roll diameter of 300 mm: 50%)-annealing-pickling. The corrosion resistance is evaluated by rust generating area ratio after 2 days of CCT test.

In these figures, symbol ■ is a hot rolled sheet of the extreme-low CSO steel, symbol □ is a cold rolled sheet of the extreme-low CSO steel, symbol ● is a hot rolled sheet of the commercially available steel, and symbol ○ is a cold rolled sheet of the commercially available steel. From these figures, it is understood that when the cooling rate after the hot rolling is not less than 25° C./sec, there is particularly an effect of considerably improving the corrosion resistance for the extreme-low CSO steel.

Coiling temperature of not higher than 650° C.;

The coiling temperature affects the adhesion property between scale and iron matrix and the amount of scale produced after the coiling. When the coiling temperature exceeds 650° C., it is insufficient to weaken the adhesion property between scale and iron matrix and also the amount of scale produced after the coiling is increased. For this end, the growth of the Cr-removed layer is promoted at the subsequent annealing to degrade the corrosion resistance. Therefore, in order to control the Cr-removed layer to improve the corrosion resistance, it is necessary to restrict the coiling temperature to not higher than 650° C. Although the coiling temperature is desired to be low, if it is too low, the surface defect in the coiling is increased to increase the unevenness after the pickling based on factors other than the Cr-removed layer, so that the coiling is desirable to be carried out at a temperature of not lower than 200° C.

The influence of the coiling temperature after the hot rolling upon corrosion resistance of each of hot rolled sheet and cold rolled sheet is shown in FIG. 5 using extreme-low CSO steel (C: 0.0050 wt %, S: 0.0040 wt %, O: 0.0040 wt %) and commercially available steel (C: 0.0500 wt %, S: 0.0082 wt %, O: 0.0068 wt %) as two kinds of SUS 304, and in FIG. 6 using extreme-low CSO steel (C: 0.0020 wt %, S: 0.0038 wt %, O: 0.0030 wt %) and commercially available steel (C: 0.0520 wt %, S: 0.0068 wt %, O: 0.0065 wt %) as two kinds of SUS 430, respectively. Moreover, the hot rolled sheet is obtained by subjecting to hot rolling (draft below 830° C.:40%, cooling rate: 40° C./sec)-annealing-pickling, and the cold rolled sheet is obtained by subjecting to hot rolling (draft below 830° C.: 40%, cooling rate: 45° C./sec) -annealing-pickling-cold rolling (draft at roll diameter of 250 mm: 45%)-annealing-pickling. The corrosion resistance is evaluated by rust generating area ratio after 2 days of CCT test.

In these figures, symbol ■ is a hot rolled sheet of the extreme-low CSO steel, symbol □ is a cold rolled sheet of the extreme-low CSO steel, symbol ● is a hot rolled sheet of the commercially available steel, and symbol ○ is a cold rolled sheet of the commercially available steel. From these figures, it is understood that when the coiling temperature after the hot rolling and quenching is not higher than 650° C., there is particularly an effect of considerably improving the corrosion resistance for the extreme-low CSO steel.

Thickness of hot rolled sheet of not more than 1.5 mm and draft of skin pass rolling of not more than 20%;

In general, stainless steel sheets having a thickness of not more than 1.5 mm are produced by subjecting the hot rolled sheet to a cold rolling. Of course, cold rolled stainless steel sheets can be produced by applying the invention to the above process, but it is recently attempted to produce stainless steel sheets having a thickness of not more than 1.5 mm by so-called hot rolling-annealing-pickling steps with omission of cold rolling step in accordance with the increase of capacity of hot rolling mill and the reduction of slab thickness. If the steel sheet is produced at such steps according to the conventional technique, there is a problem that the surface chapping is still retained after the pickling to lower the corrosion resistance as compared with the conventional cold rolled sheet.

On the other hand, the process according to the invention develops a remarkable effect when the steel sheet is produced at the above steps, particularly when the skin pass rolling is carried out at a draft of not more than 20% for the hot rolled sheet having a thickness of not more than 1.5 mm. That is, the thickness of the hot rolled sheet is restricted to not more than 1.5 mm and the draft of the skin pass rolling is restricted to not more than 20%, preferably 1–15%. According to the invention process, it is possible to produce stainless steel corresponding to the conventional bright-finished cold rolled sheet at the above steps.

Work roll diameter of not less than 250 mm in a cold rolling installation and total draft of more than 20% through work rolls;

In general, stainless steel cold rolled sheets are produced by cold rolling with rolls having a diameter of not more than 100 mm, but the productivity is very low as compared with a tandem rolling mill using a large-size roll usually used in the rolling of general-purpose steel. For this end, there has recently been increased a case of subjecting the stainless steel to cold rolling through the tandem rolling mill. However, when using the tandem rolling mill, there is a problem that surface defect is apt to be caused by falling down the unevenness of the surface before the cold rolling to lower the corrosion resistance.

The invention process develops a remarkable effect at the above step, particularly when cold rolling is carried out at a total draft of more than 20% through work rolls having a diameter of not less than 250 mm, so that the work roll diameter in the cold rolling installation is restricted to not less than 250 mm and the total draft through the work rolls is restricted to more than 20%. After such a cold rolling, annealing-pickling or bright annealing may be conducted according to the usual manner.

According to the invention, production conditions other than those in the above steps are not particularly critical, and may be within usual manner. For example, it is favorable that the heating temperature of slab is 1000°–1300° C., and the annealing temperature is 700°–1300° C., and the pickling condition is an immersion in mixed acid (nitric acid and hydrofluoric acid) after the immersion in sulfuric acid. Further, it is preferable to conduct a passivating treatment after the pickling in order to more improve the corrosion resistance.

The chemical composition of stainless steel preferably applied to the invention will be described below.

C: not more than 0.010 wt %, S: not more than 0.0050 wt %, O: not more than 0.0050 wt %;

These elements lower not only the corrosion resistance of stainless steel but also the hot workability, so that it is desired to reduce amounts of these elements. Particularly, when C, S and O are included in amounts of more than 0.0100 wt %, more than 0.0050 wt % and 0.0050 wt %, respectively, the corrosion resistance is considerably degraded, and good corrosion resistance can not be obtained even if stainless steel is produced under the conditions according to the invention process. Therefore, the amounts of these elements are restricted to C: not more than 0.0100 wt %, S: not more than 0.0050 wt % and O: not more than 0.0050 wt %, preferably C: not more than 0.0030 wt %, S: not more than 0.0020 wt % and O: not more than 0.0040 wt %.

Si: not more than 3 wt %;

Si is an element effective for the increase of strength in steel, improvement of oxidation resistance, reduction of oxygen amount in steel and stabilization of ferrite phase. However, when the Si amount exceeds 3 wt %, the unevenness after annealing-pickling increases due to the increase of surface defects in the hot rolling and the degradation of corrosion resistance is caused by factors other than the Cr-removed layer, so that the Si amount is restricted to not more than 3 wt %. Moreover, the above effect appears in the amount of not less than 0.05 wt % and becomes clear in the amount of not less than 0.1 wt %.

Mn: not more than 5 wt % (ferritic), Mn: not more than 20 wt % (austenitic, dual-phase);

Mn is an element effective for the increase of strength and improvement of hot workability in ferritic stainless steel. When Mn is included in an amount of more than 5 wt %, the unevenness after annealing-pickling increases due to the increase of surface defects in the hot rolling and the degradation of corrosion resistance is caused by factors other than the Cr-removed layer, so that the amount is restricted to not more than 5 wt %. Moreover, the effect of Mn appears in an amount of not less than 0.05 wt % in the ferritic stainless steel.

Further, Mn is an element effective for not only the increase of strength and improvement of hot workability but also the stabilization of austenite phase in austenitic stainless steel or dual-phase stainless steel. When Mn is included in an amount of more than 20 wt %, the unevenness after annealing-pickling increases due to the increase of surface defects in the hot rolling and the degradation of corrosion resistance is caused by factors other than the Cr-removed layer likewise the above case, so that the amount is restricted to not more than 20 wt %. Moreover, the effect of Mn appears in an amount of not less than 0.10 wt % in the austenitic stainless steel or dual-phase stainless steel.

Cr: 9–50 wt %;

Cr is an element for the improvement of corrosion resistance, but does not contribute to improve the corrosion resistance at an amount of less than 9 wt %. On the other hand, when Cr is included in an amount of more than 50 wt %, the unevenness after annealing-pickling increases due to the increase of surface defects in the hot rolling and the degradation of corrosion resistance is caused by factors other than the Cr-removed layer, so that the amount is restricted to not more than 50 wt %.

Moreover, it is preferable that the amount is 12–30 wt % from a viewpoint of the corrosion resistance and productivity.

Ni: less than 5 wt % (ferritic), 5–20 wt % (austenitic, dual-phase);

Ni is an element effective for improving workability, oxidation resistance and toughness in ferritic stainless steel, so that it may be included in an amount of not less than about 0.1 wt %. However, when it is included in an amount of not less than 5 wt %, martensite phase is formed and the steel becomes considerably brittle, so that the amount is restricted to less than 5 wt %.

Further, Ni is an element required for not only the improvement of workability, corrosion resistance and toughness but also the stabilization of austenite phase in austenitic stainless steel and dual-phase stainless steel. When the Ni amount is less than 5 wt %, the effect is not obtained, while when it exceeds 20 wt %, the unevenness after annealing-pickling increases due to the increase of surface defects in the hot rolling and the degradation of corrosion resistance is caused by factors other than the Cr-removed layer, so that the amount is restricted to not more than 20 wt %.

N: not more than 0.2000 wt % (austenitic, dual-phase);

N is an element effective for the increase of strength and improvement of corrosion resistance in steel and the stabilization of austenite phase in austenitic stainless steel and dual phase stainless steel. When it is included in an amount of more than 0.2000 wt %, the unevenness after annealing-pickling increases due to the increase of surface defects in the hot rolling and the degradation of corrosion resistance is caused by factors other than the Cr-removed layer, so that the amount is restricted to not more than 0.2000 wt %. Moreover, the above effect appears in an amount of not less than about 0.01 wt %. And also, the N amount in ferritic stainless steel is desirable to be not more than 0.02 wt %.

In the invention, one or more elements selected from Ti: 0.01–1.0 wt %, Nb: 0.01–1.0 wt %, V: 0.01–1.0 wt %, Zr: 0.01–1.0 wt %, Ta: 0.01–1.0 wt %, Co: 0.1–5 wt %, Cu: 0.1–5 wt %, Mo: 0.1–5 wt %, W: 0.1–5 wt %, Al: 0.01–1.0 wt %, Ca: 0.0003–0.0100 wt % and B: 0.0003–0.0100 wt % may further be included into the above ferritic stainless steel, austenitic stainless steel and dual-phase stainless steel. The reason of these limitations will be described below.

① Ti: 0.01–1.0 wt %, Nb: 0.01–1.0 wt %, V: 0.01–1.0 wt %, Zr: 0.01–1.0 wt %, Ta: 0.01–1.0 wt %;

These elements are added to fix C, N in steel to provide good mechanical properties. This effect is obtained in Ti: not less than 0.01 wt %, Nb: not less than 0.01 wt %, V: not less than 0.01 wt %, Zr: not less than 0.01 wt %, Ta: not less than 0.01 wt %. When the amounts of these elements are too large, the unevenness after annealing-pickling increases due to the increase of surface defects in the steel-making and hot rolling and the degradation of corrosion resistance is caused by factors other than the Cr-removed layer, so that the amounts are restricted to Ti: not more than 1.0 wt %, Nb: not more than 1.0 wt %, V: not more than 1.0 wt %, Zr: not more than 1.0 wt %, Ta: not more than 1.0 wt %. Preferably, they are Ti: 0.01–0.6 wt %, Nb: 0.01–0.6 wt %, V: 0.01–0.6 wt %, Zr: 0.01–0.6 wt %, Ta: 0.01–0.6 wt %.

Moreover, each element in this element group has function and effect substantially common to those of the following element groups, so that substantially the same function and effect are developed even in a combination of the other elements when using one of these elements. Therefore, elements in each group will be described together in the following explanation.

② Co: 0.1–5 wt %, Cu: 0.1–5 wt %;

These elements have an effect of improving the workability and toughness in the ferritic stainless steel and have an effect of stabilizing austenite phase to control the formation of strain induced martensite or the like and improving the workability in the austenitic stainless steel and dual-phase stainless steel. These effects are obtained in Co: not more than 0.1 wt %, Cu: not less than 0.1 wt % in any stainless steels. However, when the amounts of these alloying elements are too large, the unevenness after annealing-pickling increases due to the increase of surface defects in the hot rolling and the degradation of corrosion resistance is caused by factors other than the Cr-removed layer, so that the amounts are restricted to Co: not more than 5 wt %, Cu: not more than 5 wt %.

③ Mo: 0.1–5 wt %, W: 0.1–5 wt %;

These elements have an effect of improving the corrosion resistance of stainless steel. This effect is obtained in Mo: not less than 0.1 wt %, W: not less than 0.1 wt %. However, when the amounts of these alloying elements are too large, the unevenness after annealing-pickling increases due to the increase of surface defects in the hot rolling and the degradation of corrosion resistance is caused by factors other than the Cr-removed layer, so that the amounts are restricted to Mo: not more than 5 wt %, W: not more than 5 wt %.

④ Al: 0.005–5.0 wt %;

Al has an effect for improving not only the oxidation resistance of steel but also the strength. This effect is obtained in an amount of not less than 0.005 wt %. However, when the Al amount is too large, the unevenness after annealing-pickling increases due to the increase of surface defects in the steel-making and hot rolling and the degradation of corrosion resistance is caused by factors other than the Cr-removed layer, so that the amount is restricted to not more than 5.0 wt %.

⑤ Ca: 0.0003–0.0100 wt %;

Ca has an effect of controlling the form of inclusion in steel and the strength to improve the mechanical properties and toughness. This effect is obtained in an amount of not less than 0.0003 wt %. However, when the addition amount is too large, the unevenness after annealing-pickling increases due to the increase of surface defects in the steel-making and hot rolling and the degradation of corrosion resistance is caused by factors other than the Cr-removed layer, so that the amount is restricted to not more than 0.0100 wt %.

⑥ B: 0.0003–0.0100 wt %;

B has an effect of causing segregation in grain boundary to increase the strength of grain boundary and improve secondary work brittleness. This effect is obtained in an amount of not less than 0.0003 wt %. However, when the addition amount is too large, the unevenness after annealing-pickling increases due to the increase of surface defects in the steel-making and hot rolling and the degradation of corrosion resistance is caused by factors other than the Cr-removed layer, so that the amount is restricted to not more than 0.0100 wt %.

Particularly, the other components are not necessarily restricted, but it is desirable that P is not more than 0.05 wt %.

As the above selective addition elements in the invention, it is effective to use elements in each group of ①–⑥ alone or add a combination of 2 or more elements selected from the groups of ①–⑥.

BEST MODE FOR CARRYING OUT THE INVENTION

Figure 1:
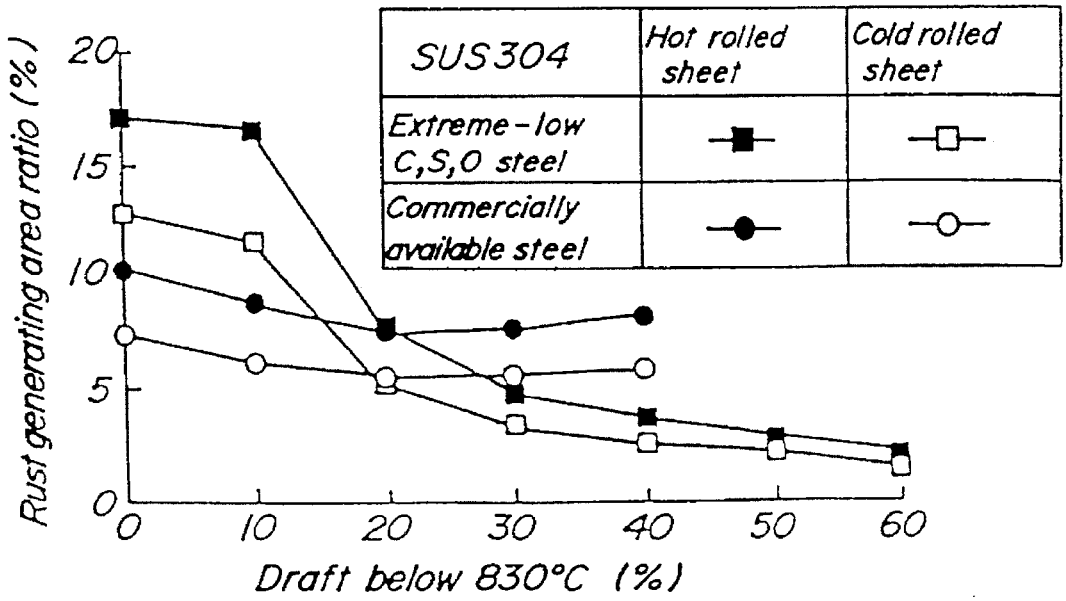
FIG. 1 is a graph showing a relation between draft below 830° C. and rust generating area ratio in SUS 304 stainless steel.
Figure 2:
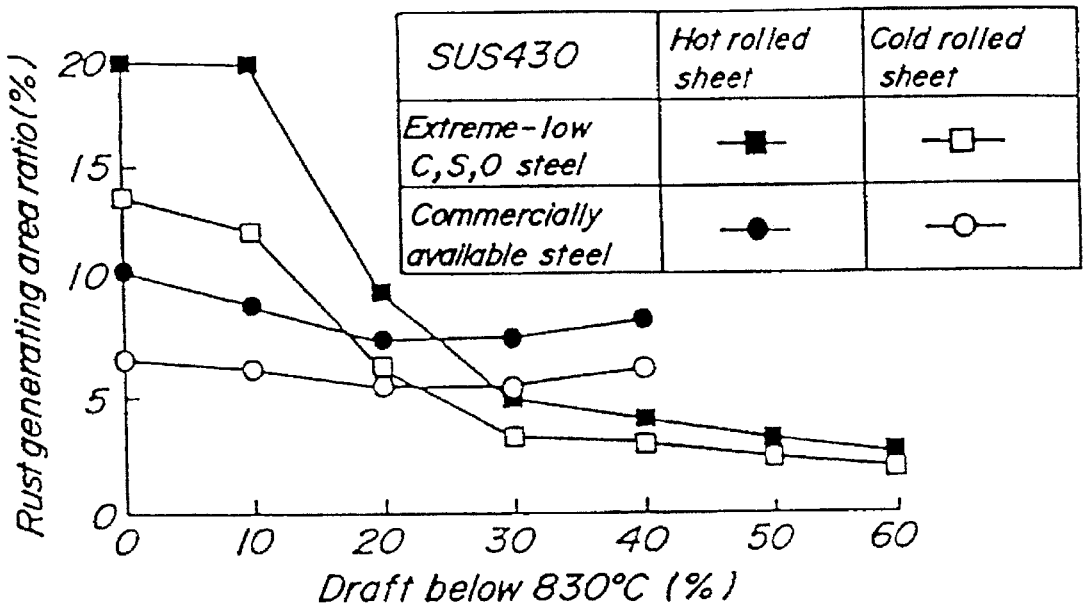
FIG. 2 is a graph showing a relation between draft below 830° C. and rust generating area ratio in SUS 430 stainless steel.
Figure 3:
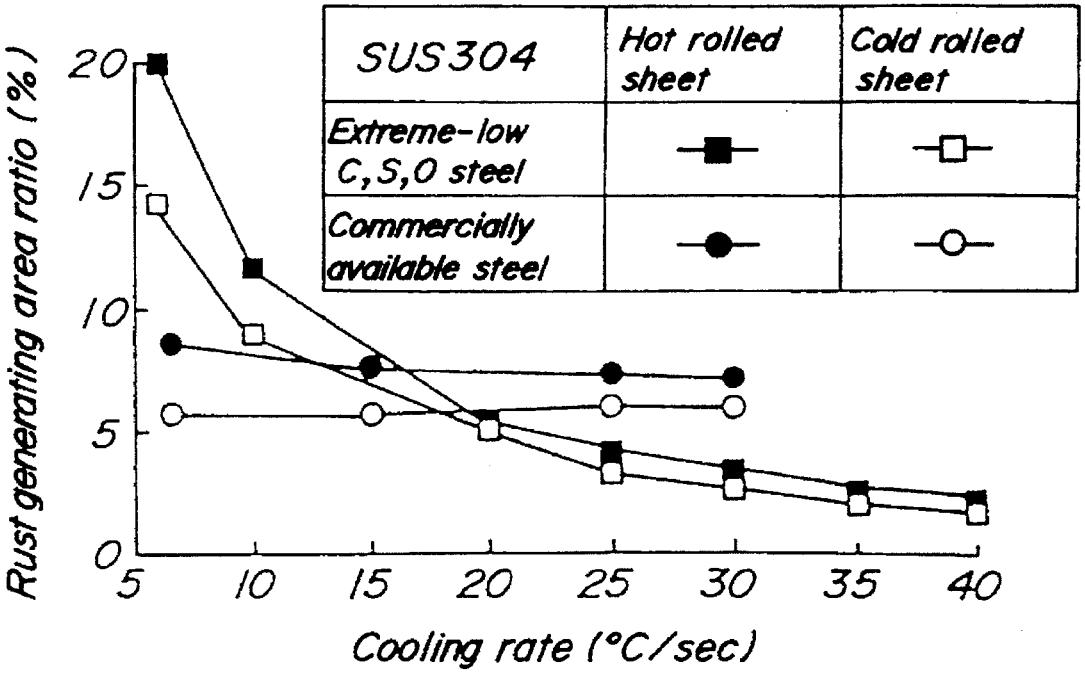
FIG. 3 is a graph showing a relation between cooling rate after the completion of hot rolling and rust generating area ratio in SUS 304 stainless steel.
Figure 4:
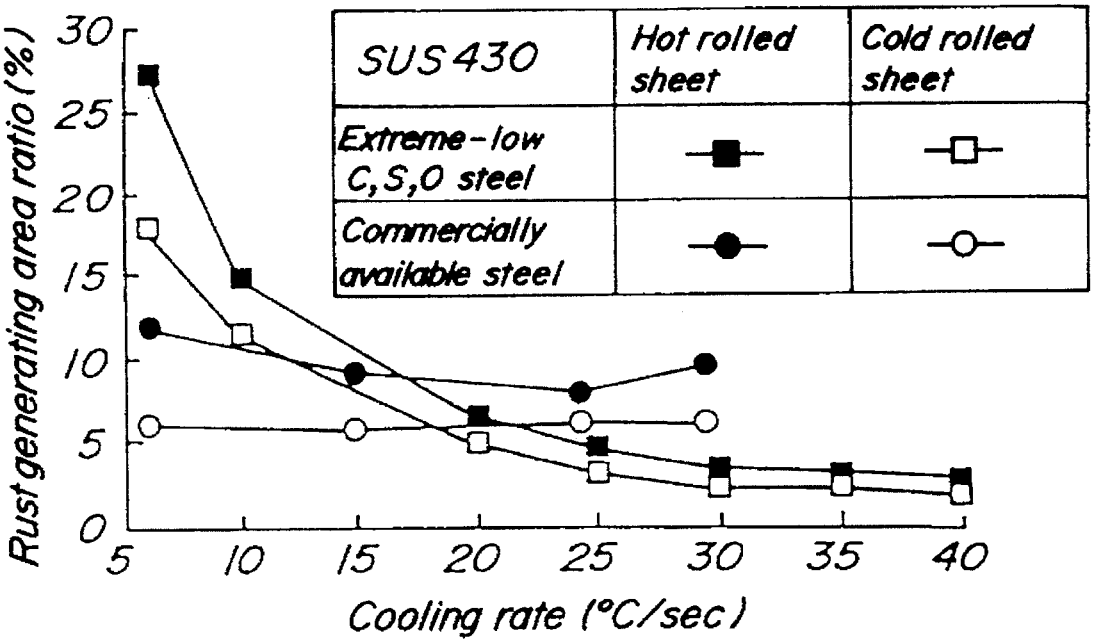
FIG. 4 is a graph showing a relation between cooling rate after the completion of hot rolling and rust generating area ratio in SUS 430 stainless steel.
Figure 5:
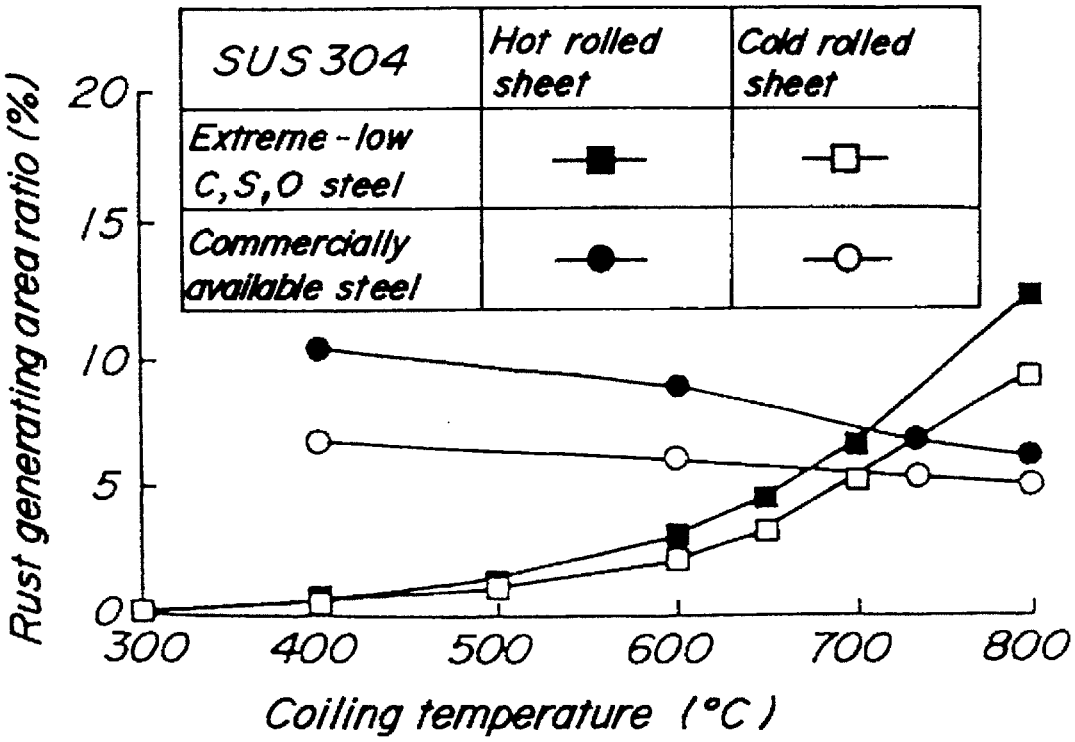
FIG. 5 is a graph showing a relation between coiling temperature and rust generating area ratio in SUS 304 stainless steel.
Figure 6:
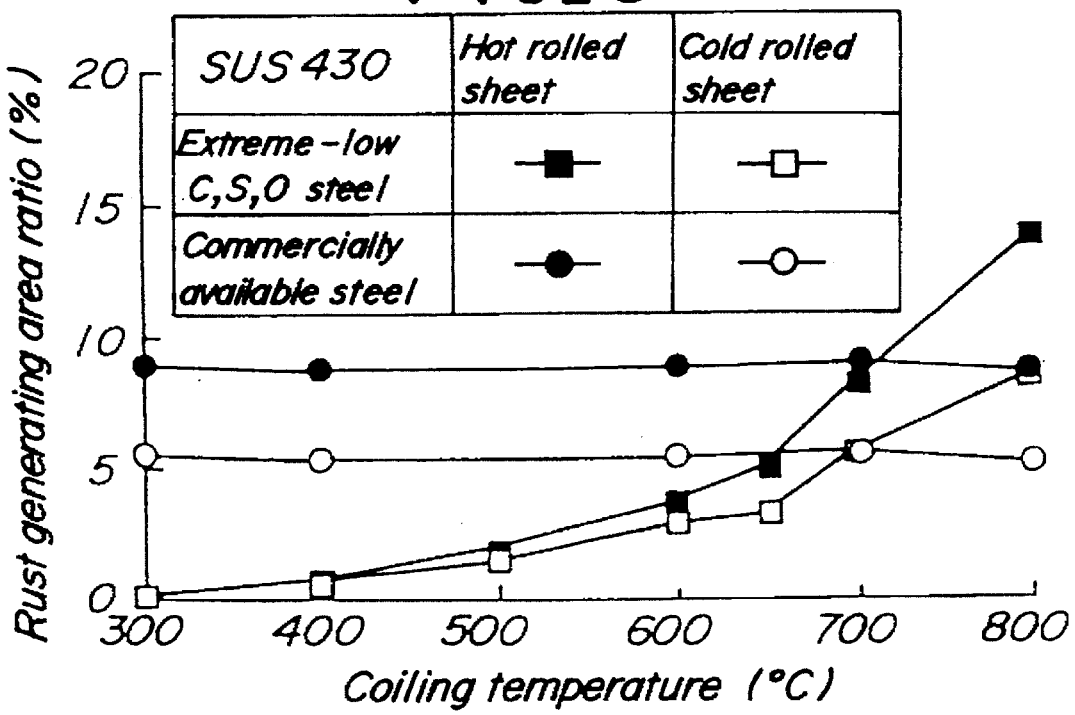
FIG. 6 is a graph showing a relation between coiling temperature and rust generating area ratio in SUS 430 stainless steel.

Each of stainless steels having chemical compositions shown in Tables 1 to 4 (In a column of kind of steel in each Table, F is ferritic, A is austenitic and D is dual-phase) is melted in a convertor, subjected to degassing by VOD process and adjustment of slight components, and continuously cast into a slab of 200 mm in thickness.

Then, the slab is reheated at 1200° C. for 2 hours, rough-rolled to a thickness of 10–20 mm, and further continuously finish rolled to obtain a hot rolled sheet having a thickness of 0.9–4 mm. This hot rolling step is carried out under various conditions of draft below 830° C., finish temperature of hot rolling, cooling rate and coiling temperature.

After the hot rolling, the hot rolled sheets No. 1–49, 90, 92 and 94–98 are subjected to a continuous annealing in which they are heated at 1150° C. in a butane burning atmosphere for 1 minute and cooled to room temperature with water, and the hot rolled sheets No. 50–56, No. 72, 80, 81 and 93 are subjected to a continuous annealing in which they are heated at 1000° C. in a butane burning atmosphere for 1 minute and cooled to room temperature with water, and the hot rolled sheets No. 57–71, 73–79, 82–89, 91, 95 and 99–101 are subjected to a batch annealing in which they are heated at 850° C. in an atmosphere of $H_2$ gas: 5% and the remainder: $N_2$ gas having a dew point of −30° C. for 5 hours and gradually cooled to room temperature. Thereafter, the annealed sheets are subjected to a mechanical preliminary descaling with shot blast, immersed in an aqueous solution of 80° C. containing $H_2SO_4$: 200 g/l (0.2 g/cm$^3$) for 10 seconds and then immersed in an aqueous solution of 60° C. containing HF: 25 g/l (0.025 g/cm$^3$) and $HNO_3$: 150 g/l (0.150 g/cm$^3$) for 10 seconds and washed with water to complete pickling and descaling.

TABLE 1

| No. | Kind of steel | Chemical composition (wt %) | | | | | | | | | |
|---|---|---|---|---|---|---|---|---|---|---|---|
| | | C | S | O | Si | Mn | Cr | Ni | N | P | others |
| 1 | A | 0.0042 | 0.0038 | 0.0025 | 0.62 | 1.22 | 17.1 | 7.0 | 0.1081 | 0.0274 | 0.06 Nb, 0.60 Cu |
| 2 | A | 0.0012 | 0.0035 | 0.0038 | 0.57 | 1.03 | 17.7 | 8.8 | 0.0248 | 0.0332 | |
| 3 | A | 0.0018 | 0.0038 | 0.0011 | 0.56 | 1.05 | 18.4 | 8.7 | 0.0372 | 0.0330 | |
| 4 | A | 0.0055 | 0.0031 | 0.0007 | 0.55 | 1.00 | 17.8 | 8.5 | 0.0387 | 0.0329 | 0.30 Cu |
| 5 | A | 0.0049 | 0.0039 | 0.0034 | 0.55 | 1.01 | 18.0 | 8.5 | 0.0386 | 0.0334 | 0.30 Cu |
| 6 | A | 0.0041 | 0.0011 | 0.0012 | 0.55 | 1.03 | 18.4 | 8.3 | 0.0377 | 0.0330 | 1.0 Cu |
| 7 | A | 0.0053 | 0.0039 | 0.0033 | 0.57 | 1.02 | 18.5 | 9.2 | 0.0315 | 0.0337 | 0.30 Cu |
| 8 | A | 0.0005 | 0.0015 | 0.0008 | 0.44 | 1.37 | 17.9 | 8.3 | 0.0372 | 0.0314 | 0.20 Ti, 0.30 Cu |
| 9 | A | 0.0018 | 0.0016 | 0.0032 | 0.44 | 1.38 | 18.0 | 8.2 | 0.0370 | 0.0315 | 0.20 Ti |
| 10 | A | 0.0013 | 0.0025 | 0.0026 | 0.46 | 1.36 | 17.6 | 8.2 | 0.0371 | 0.0319 | 0.20 Ti, 0.30 Cu |
| 11 | A | 0.0037 | 0.0018 | 0.0008 | 0.54 | 0.99 | 17.9 | 8.3 | 0.0377 | 0.0032 | 0.30 Cu |
| 12 | A | 0.0014 | 0.0031 | 0.0011 | 0.54 | 1.51 | 18.6 | 9.3 | 0.0357 | 0.0311 | |
| 13 | A | 0.0013 | 0.0023 | 0.0024 | 0.61 | 1.19 | 18.4 | 8.9 | 0.0375 | 0.0251 | 0.090 Al |
| 14 | A | 0.0041 | 0.0014 | 0.0023 | 0.58 | 1.68 | 18.7 | 9.7 | 0.0247 | 0.0243 | 0.025 Ti |
| 15 | A | 0.0026 | 0.0009 | 0.0038 | 0.60 | 1.66 | 18.0 | 11.0 | 0.0249 | 0.0248 | |
| 16 | A | 0.0044 | 0.0016 | 0.0034 | 0.39 | 1.70 | 18.1 | 11.2 | 0.0249 | 0.0245 | 0.025 Al |
| 17 | A | 0.0009 | 0.0007 | 0.0021 | 0.41 | 1.67 | 17.8 | 11.3 | 0.0252 | 0.0301 | 0.1 Al |
| 18 | A | 0.0021 | 0.0024 | 0.0035 | 0.59 | 1.29 | 16.5 | 10.6 | 0.0245 | 0.0329 | 0.020 Ti, 2.20 Mo, 0.0030 B |
| 19 | A | 0.0046 | 0.0009 | 0.0037 | 0.58 | 1.33 | 16.2 | 12.3 | 0.0251 | 0.0327 | 0.020 Ti, 2.20 Mo |
| 20 | A | 0.0031 | 0.0029 | 0.0037 | 0.59 | 1.48 | 14.4 | 15.4 | 0.0380 | 0.0244 | 0.08 Al |
| 21 | A | 0.0038 | 0.0033 | 0.0022 | 0.41 | 0.70 | 16.7 | 7.1 | 0.0255 | 0.0245 | 1.04 Al |
| 22 | A | 0.0035 | 0.0014 | 0.0009 | 0.80 | 1.56 | 24.1 | 19.3 | 0.0255 | 0.0298 | |
| 23 | A | 0.0023 | 0.0007 | 0.0038 | 0.45 | 1.36 | 18.1 | 8.4 | 0.0379 | 0.0324 | 0.02 Nb |
| 24 | D | 0.0052 | 0.0037 | 0.0022 | 0.45 | 1.34 | 46.7 | 18.7 | 0.0378 | 0.0326 | 0.02 V |
| 25 | A | 0.0046 | 0.0016 | 0.0029 | 0.44 | 1.37 | 18.6 | 8.6 | 0.0389 | 0.0316 | 0.05 Ta |

TABLE 2

| No. | Kind of steel | Chemical composition (wt %) | | | | | | | | | |
|---|---|---|---|---|---|---|---|---|---|---|---|
| | | C | S | O | Si | Mn | Cr | Ni | N | P | others |
| 26 | A | 0.0042 | 0.0035 | 0.0013 | 0.46 | 1.31 | 17.6 | 8.3 | 0.0375 | 0.0322 | 0.08 Zr |
| 27 | A | 0.0047 | 0.0018 | 0.0039 | 0.46 | 1.38 | 18.2 | 8.2 | 0.0374 | 0.0319 | 0.30 Co |
| 28 | A | 0.0040 | 0.0026 | 0.0030 | 0.59 | 1.26 | 16.7 | 11.9 | 0.0253 | 0.0340 | 3.0 Mo |
| 29 | A | 0.0043 | 0.0035 | 0.0008 | 0.61 | 1.30 | 15.9 | 12.1 | 0.0246 | 0.0335 | 3.0 N |
| 30 | A | 0.0039 | 0.0023 | 0.0038 | 0.62 | 1.28 | 16.3 | 10.3 | 0.0251 | 0.0335 | 0.0030 B |
| 31 | A | 0.0021 | 0.0018 | 0.0017 | 0.54 | 1.00 | 18.0 | 8.5 | 0.0289 | 0.0330 | 0.0030 Ca |
| 32 | A | 0.0038 | 0.0037 | 0.0025 | 0.55 | 1.04 | 18.6 | 8.3 | 0.0385 | 0.0328 | 0.30 Cu, 0.0030 Ca |
| 33 | A | 0.0045 | 0.0037 | 0.0023 | 0.48 | 0.98 | 16.8 | 7.9 | 0.0374 | 0.0338 | 0.20 Ti, 0.02 Al, 0.0018 Ca |
| 34 | A | 0.0018 | 0.0030 | 0.0007 | 0.51 | 0.95 | 17.1 | 8.8 | 0.0412 | 0.0334 | 0.20 Ti, 0.01 Al, 0.0011 B |
| 35 | A | 0.0044 | 0.0012 | 0.0032 | 0.59 | 1.35 | 18.5 | 8.1 | 0.0219 | 0.0316 | 0.20 Ti, 0.01 Al, 0.0020 Ca, 0.0010 B |
| 36 | A | 0.0048 | 0.0015 | 0.0028 | 0.53 | 0.98 | 16.1 | 10.4 | 0.0355 | 0.0313 | 0.20 Ti, 0.01 Al, 0.0020 Ca, 2.5 Mo |
| 37 | A | 0.0018 | 0.0026 | 0.0024 | 0.56 | 1.05 | 17.4 | 10.1 | 0.0415 | 0.0310 | 0.20 Ti, 0.02 Al, 0.0015 B, 2.5 Mo |
| 38 | A | 0.0038 | 0.0031 | 0.0037 | 0.58 | 1.12 | 16.5 | 10.3 | 0.0255 | 0.0319 | 0.20 Ti, 0.02 Al, 0.0021 Ca, 0.0009 B, 2.5 Mo |
| 39 | A | 0.0013 | 0.0015 | 0.0038 | 0.55 | 1.17 | 19.8 | 7.4 | 0.0240 | 0.0297 | 0.20 Ti, 0.01 Al, 0.30 Cu |
| 40 | A | 0.0025 | 0.0017 | 0.0010 | 0.52 | 0.95 | 16.8 | 7.8 | 0.0390 | 0.0303 | 0.21 Ti, 0.01 Al, 0.0022 Ca, 0.30 Cu |
| 41 | A | 0.0009 | 0.0024 | 0.0031 | 0.54 | 0.98 | 20.5 | 9.1 | 0.0357 | 0.0317 | 0.20 Ti, 0.01 Al, 0.0010 B, 0.30 Cu |
| 42 | A | 0.0043 | 0.0027 | 0.0030 | 0.61 | 1.05 | 17.6 | 9.0 | 0.0382 | 0.0292 | 0.21 Ti, 0.01 Al, 0.0023 Ca, 0.0015 B, 0.30 Cu |
| 43 | A | 0.0036 | 0.0023 | 0.0014 | 0.48 | 1.02 | 18.4 | 8.4 | 0.0370 | 0.0262 | 0.19 Ti, 0.0008 Ca |
| 44 | A | 0.0049 | 0.0029 | 0.0040 | 0.52 | 1.02 | 16.3 | 8.8 | 0.0357 | 0.236 | 0.20 Ti, 0.0010 B |
| 45 | A | 0.0022 | 0.0031 | 0.0009 | 0.55 | 1.02 | 15.2 | 10.3 | 0.0401 | 0.0279 | 0.20 Ti, 0.0020 Ca, 2.0 Mo |
| 46 | A | 0.0018 | 0.0017 | 0.0014 | 0.56 | 0.93 | 17.0 | 10.0 | 0.0346 | 0.0272 | 0.20 Ti, 0.0021 Ca, 0.0010 B, 2.0 Mo |
| 47 | A | 0.0049 | 0.0021 | 0.0033 | 0.52 | 1.12 | 16.6 | 8.8 | 0.0367 | 0.0267 | 0.20 Ti, 0.0020 Ca, 0.16 Cu |
| 48 | A | 0.0028 | 0.0030 | 0.0034 | 0.57 | 0.92 | 16.9 | 9.0 | 0.0349 | 0.0251 | 0.20 Ti, 0.0010 B, 1.0 Cu |
| 49 | A | 0.0032 | 0.0013 | 0.0023 | 0.51 | 0.92 | 17.7 | 9.0 | 0.0418 | 0.0282 | 0.20 Ti, 0.0020 Ca, 0.0014 B, 1.0 Cu |

TABLE 3

| No. | Kind of steel | Chemical composition (wt %) C | S | O | Si | Mn | Cr | Ni | N | P | others |
|---|---|---|---|---|---|---|---|---|---|---|---|
| 50 | F | 0.0013 | 0.0015 | 0.0037 | 0.50 | 0.43 | 11.8 | — | 0.0083 | 0.0270 | 0.20 Ti, 0.01 Al, 0.30 Cu |
| 51 | F | 0.0025 | 0.0017 | 0.0009 | 0.54 | 0.53 | 11.8 | — | 0.0071 | 0.0272 | 0.21 Ti, 0.01 Al, 0.0022 Ca, 0.30 Cu |
| 52 | F | 0.0009 | 0.0025 | 0.0031 | 0.41 | 0.54 | 11.5 | — | 0.0089 | 0.0183 | 0.20 Ti, 0.01 Al, 0.0010 B, 0.30 Cu |
| 53 | F | 0.0043 | 0.0027 | 0.0030 | 0.46 | 0.43 | 11.6 | — | 0.0089 | 0.0256 | 0.21 Ti, 0.01 Al, 0.0023 Ca, 0.0015 B, 0.30 Cu |
| 54 | F | 0.0047 | 0.0022 | 0.0032 | 0.58 | 0.47 | 11.6 | — | 0.0087 | 0.0203 | 0.20 Ti, 0.0020 Ca, 0.16 Cu |
| 55 | F | 0.0029 | 0.0032 | 0.0033 | 0.50 | 0.41 | 11.9 | — | 0.0074 | 0.0279 | 0.20 Ti, 0.0010 B, 1.0 Cu |
| 56 | F | 0.0031 | 0.0013 | 0.0024 | 0.50 | 0.54 | 11.7 | — | 0.0072 | 0.0243 | 0.20 Ti, 0.0020 Ca, 0.0014 B, 1.0 Cu |
| 57 | F | 0.0008 | 0.0034 | 0.0014 | 0.31 | 0.59 | 16.2 | — | 0.0046 | 0.0309 | |
| 58 | F | 0.0049 | 0.0029 | 0.0027 | 0.32 | 0.60 | 16.4 | — | 0.0054 | 0.0299 | 0.012 Al |
| 59 | F | 0.0006 | 0.0029 | 0.0037 | 0.32 | 0.66 | 15.9 | 0.3 | 0.0038 | 0.0300 | 0.012 Al |
| 60 | F | 0.0025 | 0.0018 | 0.0035 | 0.39 | 0.64 | 16.4 | — | 0.0034 | 0.0301 | 0.07 Al |
| 61 | F | 0.0026 | 0.0021 | 0.0028 | 0.88 | 0.92 | 17.1 | 0.5 | 0.0049 | 0.0297 | 0.065 Al |
| 62 | F | 0.0044 | 0.0030 | 0.0009 | 0.54 | 0.65 | 15.8 | — | 0.0040 | 0.0306 | 0.012 Al |
| 63 | F | 0.0027 | 0.0015 | 0.0021 | 0.10 | 0.31 | 16.8 | — | 0.0050 | 0.0347 | 0.01 Al, 0.22 Nb, 0.85 Mo |
| 64 | F | 0.0025 | 0.0022 | 0.0013 | 0.10 | 0.30 | 16.3 | — | 0.0051 | 0.0354 | 0.22 Nb, 0.85 Mo, 0.065 Al |
| 65 | F | 0.0037 | 0.0020 | 0.0032 | 0.10 | 0.30 | 18.1 | — | 0.0049 | 0.0346 | 0.27 Nb. 1.80 Mo, 0.05 Al |
| 66 | F | 0.0045 | 0.0028 | 0.0038 | 0.29 | 0.15 | 18.6 | — | 0.0051 | 0.0343 | 0.35 Nb, 1.90 Mo, 0.01 Al |
| 67 | F | 0.0005 | 0.0010 | 0.0033 | 0.25 | 0.30 | 18.0 | — | 0.0131 | 0.0356 | 0.38 Nb, 0.55 Mo, 0.03 Al |
| 68 | F | 0.0019 | 0.0033 | 0.0013 | 0.40 | 0.30 | 16.9 | — | 0.0141 | 0.0360 | 0.42 Nb, 0.01 Al |
| 69 | F | 0.0036 | 0.0008 | 0.0030 | 0.40 | 0.30 | 18.3 | — | 0.0140 | 0.0360 | 0.47 Nb, 0.01 Al |
| 70 | F | 0.0026 | 0.0017 | 0.0035 | 0.06 | 0.15 | 17.4 | — | 0.0082 | 0.0256 | 1.20 Mo, 0.27 Ti, 0.025 Al |
| 70 | F | 0.0042 | 0.0022 | 0.0040 | 0.06 | 0.15 | 17.6 | — | 0.0081 | 0.0249 | 1.20 Mo, 0.27 Ti, 0.025 Al |
| 72 | F | 0.0019 | 0.0021 | 0.0010 | 0.20 | 0.10 | 29.5 | 0.3 | 0.0071 | 0.0183 | 0.14 Nb, 1.85 Mo, 0.1 Al |
| 73 | F | 0.0051 | 0.0026 | 0.0024 | 0.50 | 0.49 | 10.9 | — | 0.0082 | 0.0257 | 0.25 Ti, 0.03 Al |
| 74 | F | 0.0035 | 0.0032 | 0.0021 | 0.35 | 0.24 | 11.1 | — | 0.0082 | 0.0171 | 0.22 Ti, 0.07 V, 0.025 Al |
| 75 | F | 0.0039 | 0.0013 | 0.0013 | 0.25 | 0.30 | 10.8 | — | 0.0098 | 0.0198 | 0.25 Ti, 0.02 Al |

TABLE 4

| No. | Kind of steel | Chemical composition (wt %) C | S | O | Si | Mn | Cr | Ni | N | P | others |
|---|---|---|---|---|---|---|---|---|---|---|---|
| 76 | F | 0.0034 | 0.0014 | 0.0006 | 0.38 | 0.25 | 11.2 | — | 0.0091 | 0.0306 | 0.31 Ti, 0.045 Al |
| 77 | F | 0.0008 | 0.0008 | 0.0032 | 0.24 | 0.29 | 10.9 | — | 0.0072 | 0.0177 | 0.25 Ti, 0.02 Al |
| 78 | F | 0.0028 | 0.0009 | 0.0023 | 0.25 | 0.31 | 10.8 | — | 0.0070 | 0.0249 | 0.25 Ti, 0.02 Al |
| 79 | F | 0.0017 | 0.0036 | 0.0012 | 0.40 | 0.29 | 17.4 | — | 0.0141 | 0.0358 | 0.10 V |
| 80 | F | 0.0051 | 0.0019 | 0.0022 | 0.20 | 0.10 | 45.2 | 0.3 | 0.0068 | 0.0181 | 0.10 Zr |
| 81 | F | 0.0041 | 0.0023 | 0.0019 | 0.20 | 0.10 | 45.6 | 0.3 | 0.0071 | 0.0183 | 0.10 Zr, 1.85 Mo |
| 82 | F | 0.0018 | 0.0009 | 0.0019 | 0.39 | 0.31 | 17.4 | — | 0.0141 | 0.0360 | 0.08 Ta |
| 83 | F | 0.0051 | 0.0039 | 0.0013 | 0.40 | 0.30 | 17.3 | — | 0.0144 | 0.0351 | 0.5 Cu |
| 84 | F | 0.0023 | 0.0010 | 0.0009 | 0.40 | 0.31 | 17.1 | — | 0.0138 | 0.0348 | 0.5 Co |
| 85 | F | 0.0042 | 0.0009 | 0.0030 | 0.10 | 0.31 | 17.6 | — | 0.0050 | 0.0346 | 1.2 Mo |
| 86 | F | 0.0053 | 0.0005 | 0.0011 | 0.10 | 0.30 | 17.5 | — | 0.0050 | 0.0344 | 1.5 W |
| 87 | F | 0.0025 | 0.0017 | 0.0018 | 0.50 | 0.49 | 11.4 | — | 0.0082 | 0.0244 | 0.0030 B |
| 88 | F | 0.0035 | 0.0013 | 0.0036 | 0.49 | 0.51 | 11.3 | — | 0.0081 | 0.0248 | 0.0030 Ca |
| 89 | F | 0.0020 | 0.0040 | 0.0038 | 0.49 | 0.49 | 11.4 | — | 0.0079 | 0.0256 | 0.25 Ti, 0.0030 B, 0.0030 Ca |
| 90 | A | 0.0033 | 0.0014 | 0.0019 | 0.55 | 1.55 | 18.1 | 9.3 | 0.0349 | 0.0311 | |
| 91 | F | 0.0010 | 0.0007 | 0.0038 | 0.10 | 0.30 | 16.9 | — | 0.0050 | 0.0351 | 0.22 Nb, 0.85 Mo |
| 92 | A | 0.0020 | 0.0006 | 0.0017 | 0.60 | 1.26 | 16.7 | 12.3 | 0.0244 | 0.0325 | 0.020 Ti, 2.20 Mo |
| 93 | F | 0.0037 | 0.0036 | 0.0023 | 0.20 | 0.10 | 29.9 | 0.3 | 0.0071 | 0.0179 | 0.14 Nb, 1.85 Mo |
| 94 | A | 0.0024 | 0.0016 | 0.0022 | 0.56 | 1.03 | 18.3 | 8.3 | 0.0374 | 0.0339 | 0.30 Cu |
| 95 | F | 0.0010 | 0.0032 | 0.0031 | 0.26 | 0.30 | 10.9 | — | 0.0068 | 0.0178 | 0.25 Ti |
| 96 | A | 0.0400 | 0.0026 | 0.0026 | 0.55 | 1.00 | 18.3 | 8.2 | 0.0390 | 0.0338 | 0.30 Cu |
| 97 | A | 0.0046 | 0.0068 | 0.0022 | 0.44 | 1.32 | 17.8 | 8.4 | 0.0385 | 0.0313 | 0.20 Ti, 0.30 Cu |
| 98 | A | 0.0011 | 0.0010 | 0.0071 | 0.46 | 1.34 | 18.0 | 8.3 | 0.0387 | 0.0311 | 0.20 Ti |
| 99 | F | 0.0215 | 0.0035 | 0.0040 | 0.25 | 0.31 | 11.2 | — | 0.0071 | 0.0251 | 0.25 Ti |
| 100 | F | 0.0023 | 0.0078 | 0.0015 | 0.06 | 0.15 | 17.8 | — | 0.0080 | 0.0254 | 1.20 Mo, 0.27 Ti |
| 101 | F | 0.0042 | 0.0019 | 0.0083 | 0.06 | 0.15 | 17.7 | — | 0.0078 | 0.0248 | 1.20 Mo, 0.27 Ti |

Each test specimens of ① as-hot-rolled, ② subjected to 10% skin pass rolling or ③ further subjected to cold rolling are made from the above hot rolled sheets and then subjected to a test for corrosion resistance.

Moreover, the test specimen ② is made from only the hot rolled sheets having a thickness of not more than 1.5 mm. Further, the test specimen ③ is made by the following method. That is, the hot rolled sheets are subjected to a cold rolling at various drafts in a tandem rolling mill comprising rolls of 250 mm in diameter. Then, the cold rolled sheets No. 1–32, 66, 68, 70, 72–74 are subjected to an annealing in which they are heated at 1150° C. in a butane gas burning atmosphere for 10 seconds and cooled in air to room temperature. Thereafter, they are subjected to an electrolysis in an aqueous solution of 80° C. neutral salt containing $Na_2SO_4$: 200 g/l at a current density: 10 A/dm$^2$ for 40 seconds so as to dissolve the steel sheet at anode, immersed in an aqueous solution of 60° C. containing HF: 25 g/l (0.025 g/cm$^3$), $HNO_3$: 55 g/l (0.055 g/cm$^3$) for 10 seconds, and subjected to an electrolysis in an aqueous solution containing $HNO_3$: 100 g/l (0.100 g/cm$^3$) at a current density: 10 A/dm$^2$ to passivate the steel sheet. The cold rolled sheets No. 33–65, 67, 69, 71, 75–77 are subjected to a bright annealing by heating at 900° C. in an ammonia decomposed gas for 10 seconds.

Tables 5–8 show not only the thickness of hot rolled sheet but also draft below 830° C., finish temperature of hot rolling, cooling rate, coiling temperature and draft of cold rolling through work rolls having a diameter of 250 mm.

TABLE 5

| | Hot rolling | | | | | | Rust generating area ratio (%) | | | |
|---|---|---|---|---|---|---|---|---|---|---|
| No. | Draft below 830° C. (%) | Temperature at completion of rolling (°C.) | Cooling rate °C./sec | Coiling tempera-ture (°C.) | Thickness of hot rolled sheet (mm) | Draft in cold rolling (%) | Hot rolled sheet | Hot rolled skinpass sheet | Cold rolled sheet | Remarks |
| 1 | 36 | 720 | 93 | 464 | 2.2 | 64 | 0.5 | — | 0.4 | Invention process |
| 2 | 32 | 690 | 44 | 523 | 2.1 | 76 | 2.0 | — | 1.4 | |
| 3 | 36 | 780 | 31 | 609 | 3.9 | 79 | 4.0 | — | 2.7 | |
| 4 | 38 | 810 | 50 | 497 | 3.5 | 77 | 1.1 | — | 0.8 | |
| 5 | 33 | 690 | 83 | 269 | 2.4 | 67 | 0.1 | — | 0.0 | |
| 6 | 38 | 810 | 31 | 508 | 1.7 | 53 | 1.6 | — | 1.1 | |
| 7 | 35 | 720 | 47 | 390 | 2.4 | 67 | 0.6 | — | 0.5 | |
| 8 | 34 | 810 | 56 | 462 | 1.8 | 56 | 0.3 | — | 0.2 | |
| 9 | 35 | 810 | 49 | 639 | 3.8 | 79 | 2.9 | — | 1.8 | |
| 10 | 37 | 780 | 100 | 642 | 2.2 | 64 | 1.2 | — | 0.8 | |
| 11 | 30 | 720 | 54 | 165 | 0.9 | 25 | 0.0 | 0.0 | 0.0 | |
| 12 | 32 | 720 | 42 | 459 | 2.2 | 64 | 0.7 | — | 0.5 | |
| 13 | 38 | 690 | 69 | 213 | 3.7 | 78 | 0.0 | — | 0.0 | |
| 14 | 39 | 720 | 95 | 534 | 3.8 | 79 | 0.6 | — | 0.4 | |
| 15 | 39 | 750 | 92 | 477 | 1.2 | 33 | 0.4 | 0.4 | 0.3 | |
| 16 | 39 | 780 | 71 | 396 | 3.3 | 76 | 0.3 | — | 0.2 | |
| 17 | 39 | 810 | 51 | 224 | 0.9 | 25 | 0.0 | 0.0 | 0.0 | |
| 18 | 35 | 810 | 50 | 439 | 3.3 | 76 | 0.3 | — | 0.2 | |
| 19 | 35 | 690 | 93 | 433 | 3.1 | 74 | 0.2 | — | 0.1 | |
| 20 | 33 | 780 | 48 | 412 | 3.6 | 78 | 0.6 | — | 0.5 | |
| 21 | 30 | 720 | 84 | 491 | 4.0 | 80 | 0.8 | — | 0.6 | |
| 22 | 33 | 810 | 82 | 529 | 1.6 | 50 | 0.7 | — | 0.4 | |
| 23 | 30 | 720 | 74 | 623 | 3.4 | 76 | 1.6 | — | 1.1 | |
| 24 | 33 | 750 | 55 | 548 | 2.1 | 62 | 1.4 | — | 1.1 | |
| 25 | 35 | 690 | 28 | 378 | 2.4 | 67 | 0.9 | — | 0.7 | |

TABLE 6

| | Hot rolling | | | | | | Rust generating area ratio (%) | | | |
|---|---|---|---|---|---|---|---|---|---|---|
| No. | Draft below 830° C. (%) | Temperature at completion of rolling (°C.) | Cooling rate °C./sec | Coiling tempera-ture (°C.) | Thickness of hot rolled sheet (mm) | Draft in cold rolling (%) | Hot rolled sheet | Hot rolled skinpass sheet | Cold rolled sheet | Remarks |
| 26 | 48 | 780 | 56 | 255 | 2.4 | 67 | 0.0 | — | 0.0 | Invention process |
| 27 | 31 | 750 | 82 | 325 | 2.0 | 60 | 0.1 | — | 0.1 | |
| 28 | 39 | 780 | 39 | 206 | 1.0 | 21 | 0.0 | 0.0 | 0.0 | |
| 29 | 38 | 780 | 40 | 510 | 2.5 | 68 | 0.8 | — | 0.5 | |
| 30 | 34 | 810 | 71 | 479 | 3.1 | 74 | 0.8 | — | 0.6 | |
| 31 | 34 | 810 | 56 | 248 | 2.0 | 60 | 0.0 | — | 0.0 | |
| 32 | 32 | 780 | 53 | 403 | 1.1 | 27 | 0.6 | 0.4 | 0.4 | |
| 33 | 35 | 804 | 42 | 571 | 3.0 | 50.0 | 1.0 | — | 0.5 | |
| 34 | 31 | 824 | 50 | 551 | 2.5 | 72.0 | 0.8 | — | 0.2 | |
| 35 | 36 | 824 | 51 | 596 | 3.0 | 76.7 | 0.8 | — | 0.2 | |

TABLE 6-continued

| | Hot rolling | | | | | | Rust generating area ratio (%) | | | |
|---|---|---|---|---|---|---|---|---|---|---|
| No. | Draft below 830° C. (%) | Temperature at completion of rolling (°C.) | Cooling rate °C./sec | Coiling tempera-ture (°C.) | Thickness of hot rolled sheet (mm) | Draft in cold rolling (%) | Hot rolled sheet | Hot rolled skinpass sheet | Cold rolled sheet | Remarks |
| 36 | 31 | 817 | 42 | 551 | 3.0 | 76.7 | 0.2 | — | 0.0 | |
| 37 | 34 | 805 | 37 | 618 | 2.5 | 40.0 | 0.2 | — | 0.1 | |
| 38 | 31 | 821 | 48 | 609 | 3.0 | 50.0 | 0.2 | — | 0.1 | |
| 39 | 30 | 825 | 35 | 609 | 3.0 | 50.0 | 0.8 | — | 0.4 | |
| 40 | 33 | 811 | 39 | 638 | 2.5 | 40.0 | 0.6 | — | 0.3 | |
| 41 | 34 | 808 | 47 | 590 | 2.0 | 50.0 | 0.7 | — | 0.4 | |
| 42 | 34 | 827 | 42 | 602 | 3.0 | 50.0 | 0.9 | — | 0.5 | |
| 43 | 36 | 822 | 33 | 618 | 2.0 | 65.0 | 0.7 | — | 0.3 | |
| 44 | 32 | 827 | 43 | 554 | 3.0 | 50.0 | 0.9 | — | 0.4 | |
| 45 | 33 | 805 | 36 | 584 | 3.0 | 76.7 | 0.2 | — | 0.0 | |
| 46 | 32 | 816 | 48 | 562 | 2.5 | 72.0 | 0.1 | — | 0.0 | |
| 47 | 35 | 812 | 41 | 589 | 3.0 | 66.7 | 0.7 | — | 0.2 | |
| 48 | 32 | 810 | 38 | 619 | 3.0 | 50.0 | 1.0 | — | 0.5 | |
| 49 | 30 | 824 | 36 | 621 | 3.0 | 76.7 | 0.8 | — | 0.2 | |

TABLE 7

| | Hot rolling | | | | | | Rust generating area ratio (%) | | | |
|---|---|---|---|---|---|---|---|---|---|---|
| No. | Draft below 830° C. (%) | Temperature at completion of rolling (°C.) | Cooling rate °C./sec | Coiling tempera-ture (°C.) | Thickness of hot rolled sheet (mm) | Draft in cold rolling (%) | Hot rolled sheet | Hot rolled skinpass sheet | Cold rolled sheet | Remarks |
| 50 | 30 | 802 | 40 | 558 | 3.0 | 66.7 | 1.5 | — | 0.5 | Invention |
| 51 | 31 | 788 | 30 | 558 | 3.0 | 66.7 | 1.2 | — | 0.4 | process |
| 52 | 34 | 790 | 35 | 560 | 3.0 | 66.7 | 1.3 | — | 0.4 | |
| 53 | 32 | 754 | 33 | 580 | 3.0 | 66.7 | 1.8 | — | 0.6 | |
| 54 | 32 | 800 | 32 | 600 | 3.0 | 66.7 | 2.1 | — | 0.7 | |
| 55 | 30 | 768 | 38 | 610 | 3.0 | 66.7 | 1.9 | — | 0.6 | |
| 56 | 35 | 777 | 35 | 562 | 3.0 | 66.7 | 2.0 | — | 0.7 | |
| 57 | 31 | 750 | 72 | 376 | 3.1 | 74 | 0.2 | — | 0.2 | |
| 58 | 33 | 810 | 89 | 648 | 3.8 | 79 | 3.5 | — | 2.6 | |
| 59 | 36 | 810 | 61 | 407 | 3.1 | 74 | 0.4 | — | 0.3 | |
| 60 | 36 | 690 | 56 | 272 | 3.4 | 76 | 0.1 | — | 0.0 | |
| 61 | 31 | 750 | 56 | 635 | 1.7 | 53 | 3.8 | — | 2.5 | |
| 62 | 35 | 720 | 79 | 623 | 2.1 | 62 | 2.5 | — | 1.6 | |
| 63 | 36 | 690 | 94 | 388 | 2.2 | 64 | 0.1 | — | 0.1 | |
| 64 | 40 | 810 | 77 | 323 | 3.7 | 78 | 0.0 | — | 0.0 | |
| 65 | 31 | 750 | 78 | 453 | 2.2 | 64 | 0.4 | — | 0.3 | |
| 66 | 37 | 750 | 51 | 186 | 2.7 | 70 | 0.0 | — | 0.0 | |
| 67 | 31 | 750 | 46 | 258 | 3.7 | 78 | 0.0 | — | 0.0 | |
| 68 | 39 | 780 | 55 | 250 | 1.5 | 47 | 0.0 | 0.0 | 0.0 | |
| 69 | 37 | 780 | 100 | 220 | 2.8 | 71 | 0.0 | — | 0.0 | |
| 70 | 35 | 780 | 37 | 436 | 1.0 | 50 | 0.5 | 0.5 | 0.4 | |
| 71 | 39 | 750 | 60 | 180 | 3.1 | 74 | 0.0 | — | 0.0 | |
| 72 | 33 | 720 | 55 | 183 | 1.9 | 58 | 0.0 | — | 0.0 | |
| 73 | 32 | 810 | 96 | 151 | 3.4 | 76 | 0.0 | — | 0.0 | |
| 74 | 38 | 750 | 45 | 596 | 2.3 | 65 | 3.6 | — | 2.3 | |
| 75 | 30 | 750 | 48 | 428 | 2.0 | 60 | 0.7 | — | 0.5 | |

TABLE 8

| | Hot rolling | | | | | | Rust generating area ratio (%) | | | |
|---|---|---|---|---|---|---|---|---|---|---|
| No. | Draft below 830° C. (%) | Temperature at completion of rolling (°C.) | Cooling rate °C./sec | Coiling tempera-ture (°C.) | Thickness of hot rolled sheet (mm) | Draft in cold rolling (%) | Hot rolled sheet | Hot rolled skinpass sheet | Cold rolled sheet | Remarks |
| 76 | 32 | 780 | 85 | 500 | 1.3 | 38 | 0.6 | 0.5 | 0.4 | Invention |
| 77 | 33 | 720 | 68 | 436 | 1.4 | 43 | 0.3 | 0.3 | 0.3 | process |
| 78 | 33 | 810 | 71 | 461 | 3.6 | 78 | 0.5 | — | 0.3 | |
| 79 | 30 | 690 | 31 | 589 | 3.2 | 75 | 4.6 | — | 3.2 | |
| 80 | 31 | 720 | 77 | 207 | 1.0 | 30 | 0.0 | 0.0 | 0.0 | |
| 81 | 38 | 720 | 40 | 270 | 3.9 | 79 | 0.1 | — | 0.0 | |
| 82 | 48 | 690 | 50 | 414 | 1.8 | 56 | 0.2 | — | 0.2 | |
| 83 | 36 | 810 | 28 | 191 | 1.6 | 50 | 0.0 | — | 0.0 | |
| 84 | 40 | 720 | 64 | 630 | 3.8 | 79 | 1.2 | — | 0.8 | |
| 85 | 37 | 710 | 31 | 441 | 2.4 | 67 | 0.7 | — | 0.5 | |
| 86 | 34 | 810 | 57 | 512 | 2.0 | 60 | 0.6 | — | 0.4 | |
| 87 | 31 | 810 | 30 | 377 | 1.9 | 58 | 0.6 | — | 0.4 | |
| 88 | 37 | 720 | 88 | 634 | 1.8 | 56 | 2.1 | — | 1.6 | |
| 89 | 32 | 810 | 39 | 190 | 2.9 | 72 | 0.0 | — | 0.0 | |
| 90 | 0 | 850 | 37 | 602 | 2.4 | 67 | 18.5 | — | 12.3 | Compara- |
| 91 | 17 | 800 | 29 | 616 | 3.2 | 75 | 12.2 | — | 7.7 | tive |
| 92 | 32 | 760 | 12 | 648 | 2.5 | 68 | 13.5 | — | 10.4 | process |
| 93 | 0 | 900 | 6 | 740 | 4.0 | 75 | 50.4 | — | 34.9 | |
| 94 | 33 | 810 | 29 | 731 | 2.9 | 72 | 12.1 | — | 8.9 | |
| 95 | 31 | 690 | 31 | 746 | 0.9 | 40 | 14.7 | 12.6 | 10.3 | |
| 96 | 34 | 800 | 25 | 621 | 2.1 | 62 | 41.5 | — | 29.6 | |
| 97 | 33 | 700 | 39 | 608 | 1.3 | 38 | 14.5 | — | 11.3 | |
| 98 | 31 | 800 | 30 | 643 | 3.1 | 74 | 11.2 | — | 8.7 | |
| 99 | 34 | 700 | 35 | 617 | 2.6 | 69 | 19.6 | — | 12.5 | |
| 100 | 31 | 750 | 35 | 602 | 1.2 | 33 | 13.8 | 12.5 | 9.5 | |
| 101 | 33 | 800 | 40 | 625 | 2.3 | 65 | 12.5 | — | 8.9 | |

The corrosion resistance is examined with respect to the test specimens made by the above method. That is, CCT test of spraying an aqueous solution of 35° C. containing NaCl: 5% for 4 hours, drying for 2 hours and holding in a wet atmosphere for 2 hours as one cycle is conducted, and the degree of rust generation after 2 days is compared. The results are also shown in Tables 5–8.

The sheets No. 1–89 according to the invention process exhibit good corrosion resistance because the rust generating area ratio is not more than 5% in all of hot rolled sheets, hot rolled-skin pass rolled sheets and cold rolled sheets. On the contrary, the rust generating area ratio exceeds 5% in the sheets No. 90, 91, 93 wherein the draft below 830° C. is less than 30%, the sheets No. 92, 93 wherein the cooling rate is less than 25° C./sec, the sheets No. 93, 94, 95 wherein the coiling temperature exceeds 650° C. and the sheets No. 96–101 wherein the production conditions are within the ranges defined in the invention but the C, S, O amounts are too high, so that these sheets are poor in the corrosion resistance.

INDUSTRIAL APPLICABILITY

As mentioned above, according to the invention, the starting material containing C: not more than 0.100 wt %, S: not more than 0.0050 wt % and O: not more than 0.0050 wt % is hot rolled at a draft below 830° C. of not less than 30%, cooled at a cooling rate of not less than 25° C./sec and coiled below 650° C., whereby the growth of Cr-removed layer in the annealing, which has been come into problem in stainless steels having extreme-low amounts of C, S and O, can be controlled and the surface chapping of the steel sheet in subsequent pickling can be prevented. Consequently, it is possible to considerably improve the corrosion resistance of the extreme-low C, S, O stainless steel sheet, and particularly this effect becomes large when the sheet is finished by skin pass rolling after hot rolling-annealing-pickling, or when cold rolling is conducted through large size rolls.

Furthermore, according to the invention, the surface defects can considerably be reduced, so that there are provided cold rolled sheets having a beautiful surface and a good gloss.

We claim:

1. A process for the production of stainless steel sheets having an excellent corrosion resistance, wherein said stainless steel sheet contains C: not more than 0.01 wt %, S: not more than 0.005 wt % and O: not more than 0.005 wt % said stainless steel being produced by the steps of:

hot rolling said stainless steel sheet at a draft below 830° C. of greater than about 30%, cooling the resulting hot rolled sheet at a cooling rate of greater than about 25° C./sec, coiling said stainless steel sheet at a temperature of less than about 650° C., and thereafter subjecting said stainless steel sheet to annealing and pickling.

2. The process for the production of stainless steel sheets of claim 1, further comprising the step of skin pass rolling said stainless steel sheet at a draft of less than about 20%.

3. The process for the production of stainless steel sheets of claim 1, wherein said stainless steel sheet is further subjected to a cold rolling at a total draft of more than about 20% with work rolls having a roll diameter of greater than about 250 mm.

4. A process according to anyone of claims 1 to 3, wherein said stainless steel sheet is a ferritic stainless steel comprising C: not more than 0.01 wt %, S: not more than 0.005 wt %, O: not more than 0.005 wt %, Si: not more than 3 wt %, Mn: not more than 5 wt %, Cr: 9–50 wt %, Ni: less than 5 wt %, and the remainder being Fe and inevitable impurities.

5. A process according to anyone of claims 1 to 3, wherein said stainless steel sheet is a ferritic stainless steel comprising C: not more than 0.01 wt %, S: not more than 0.005 wt %, O: not more than 0.005 wt %, Si: not more than 3 wt %, Mn: not more than 5 wt %, Cr: 9–50 wt %, Ni: less than 5 wt %, and further containing one or more elements selected from the group consisting of Ti: 0.01–1.0 wt %, Nb: 0.01–1.0 wt %, V: 0.01–1.0 wt %, Zr: 0.01–1.0 wt %, Ta: 0.01–1.0 wt %, Co: 0.1–5 wt %, Cu: 0.1–5 wt %, Mo: 0.1–5 wt %, W: 0.1–5 wt %, Al: 0.005–5.0 wt %, Ca: 0.0003–0.01 wt % and B: 0.0003–not more than 0.01 wt %, and the remainder being Fe and inevitable impurities.

6. A process according to anyone of claims 1 to 3, wherein said stainless steel sheet is selected from the group consisting of an austenitic stainless steel and a dual-phase stainless steel comprising C: not more than 0.01 wt %, S: not more than 0.005 wt %, O: not more than 0.005 wt %, Si: not more than 3 wt %, Mn: not more than 20 wt %, Cr: 9–50 wt %, Ni: 5–20 wt %, N: not more than 0.2 wt %, and the remainder being Fe and inevitable impurities.

7. A process according to anyone of claims 1 to 3, wherein said stainless steel sheet is selected from the group consisting of an austenitic stainless steel and a dual-phase stainless steel comprising C: not more than 0.01 wt %, S: not more than 0.005 wt %, O: not more than 0.005 wt %, Si: not more than 3 wt %, Mn: not more than 20 wt %, Cr: 9–50 wt %, Ni: 5–20 wt %, N: not more than 0.2 wt %, and further containing one or more elements selected from the group consisting of Ti: 0.01–1.0 wt %, Nb: 0.01–1.0 wt %, V: 0.01–1.0 wt %, Zr: 0.01–1.0 wt %, Ta: 0.01–1.0 wt %, Co: 0.1–5 wt %, Cu: 0.1–5 wt %, Mo: 0.1–5 wt %, W: 0.1–5 wt %, Al: 0.005–5.0 wt %, Ca: 0.0003–0.01 wt % and B: 0.0003–not more than 0.01 wt %, and the remainder being Fe and inevitable impurities.

* * * * *